US005729836A

United States Patent [19]

Ewing

[11] Patent Number: 5,729,836

[45] **Date of Patent: *Mar. 24, 1998**

[54] DETACHABLE MULTISECTIONAL BODY STOCKING HOSIERY

[76] Inventor: Gloria M. Ewing, P.O. Box 2213, Toluca Lake, Calif. 91610-0213

[ * ] Notice: The term of this patent shall not extend beyond the expiration date of Pat. No. 5,097,537.

[21] Appl. No.: 411,842

[22] Filed: Mar. 28, 1995

Related U.S. Application Data

[63] Continuation of Ser. No. 294,196, Aug. 22, 1994, abandoned, which is a continuation of Ser. No. 165,752, Dec. 13, 1993, abandoned, which is a continuation of Ser. No. 820,074, Jan. 13, 1992, abandoned, which is a continuation-in-part of Ser. No. 642,915, Jan. 18, 1991, Pat. No. 5,097,537.

[51] Int. Cl.[6] ..... A41D 1/00

[52] U.S. Cl. ..... 2/409; 2/69

[58] Field of Search ..... 2/409, 239, 2, 2/241, 240, 242, DIG. 9, 126, 2.1 R, 69.7, 69.5, 2.15, 73

[56] References Cited

U.S. PATENT DOCUMENTS

| | | | |
|---|---|---|---|
| D. 245,291 | 8/1977 | Curry et al. | D2/29 |
| 319,131 | 6/1885 | Ryer | 2/239 |
| 1,833,163 | 11/1931 | Ischinger | 2/239 |
| 2,334,498 | 11/1943 | Merkent | 2/126 |
| 3,249,110 | 5/1966 | Bryan | 2/409 |
| 3,253,599 | 5/1966 | Bjorn-Larsen | 2/409 |
| 3,466,667 | 9/1969 | Rosner | 2/239 |
| 3,566,411 | 3/1971 | Gordon | 2/240 |
| 3,678,514 | 7/1972 | Safrit et al. | 2/212 |
| 3,845,506 | 11/1974 | Harris | 2/409 |
| 4,089,064 | 5/1978 | Chandler, Jr. | 2/2 |
| 4,267,607 | 5/1981 | Tino | 2/409 |
| 4,351,068 | 9/1982 | Taylor | 2/409 |
| 4,368,546 | 1/1983 | White | 2/239 |
| 4,412,433 | 11/1983 | Safrit et al. | 2/409 |
| 4,903,345 | 2/1990 | Oakley | 2/409 |
| 5,097,537 | 3/1992 | Ewing | 2/239 |
| 5,182,812 | 2/1993 | Goldsby | 2/84 |

FOREIGN PATENT DOCUMENTS

| | | | |
|---|---|---|---|
| 375131 | 6/1932 | United Kingdom | 2/239 |
| 2192529 | 1/1988 | United Kingdom | 2/69 |
| 8810074 | 12/1988 | WIPO | 2/2.1 R |

OTHER PUBLICATIONS

The Motion Picture Ad, Fall 1985, p. 29, Item J.
Night 'N Day Intimates, Autumn 1986, p. 13, Item H.
Physical Culture Ad, Summer '93, Item A.
Victoria's Secret Catalog, p. 16, Winter '90, Item C.
Fredericks of Hollywood Catalog, Summer 1986, p. 36, item C.

*Primary Examiner*—Gloria M. Hale
*Attorney, Agent, or Firm*—Lyon & Lyon LLP

[57] ABSTRACT

Multisectional body stocking having a plurality of various sections is connected by elastic attachment materials on each section in an overlapping manner. The multiple detachable hosiery sections allow the user to mix or match hosiery sections, or change the number of hosiery sections, to accommodate fashion desires, changes in clothing or a run in a particular hosiery section. The result is a versatile multisectional body stocking hosiery system which allows a user to use some of the various sections in many different combinations.

5 Claims, 1 Drawing Sheet

DETACHABLE MULTISECTIONAL BODY STOCKING HOSIERY

RELATED APPLICATIONS

This application is a continuation of application Ser. No. 08/294,196 filed Aug. 22, 1994 (now abandoned), which is a continuation of application Ser. No. 08/165,752 filed Dec. 13, 1993 (abandoned), which is a continuation of application Ser. No. 07/820,074 filed Nov. 13, 1992 (abandoned), which is a continuation-in-part of application Ser. No. 07/642,915 filed Jan. 18, 1991 now U.S. Pat. No. 5,097,537, the disclosure of which is specifically incorporated herein by reference.

FIELD OF INVENTION

The present invention relates to hosiery, and more specifically, multisectional body stocking hosiery.

BACKGROUND

Stockings have been a fashion apparel for women for decades. They have been made of nylon and silk, and other materials, to give a sheer appearance. Traditionally, they were held in place by garters. In time, pantyhose were invented to replace the garter. Pantyhose have the advantage of being sheer and form fitting, so they do not create unsightly bulk, as would a garter, in form-fitting apparel. Pantyhose also have the advantage of providing some support in the panty portion without being as restrictive as a girdle. Unfortunately, however, pantyhose are usually only manufactured and sold in four sizes: small, medium, large, queen and king sometimes by height. Thus, by necessity, ornamental selection is more limited in pantyhose than it is in stockings, which are still sold in a wide variety of ornamental designs.

In addition, traditional stockings and hosiery are made in one piece from one material. As is well known, when the wearer "runs" the stockings or panty hose (i.e., tears the hosiery material), the whole garment is rendered unsuitable. This results in a wasted material and expense, as even a small run may ruin an entire pair of panty hose or an entire stocking. Accordingly, there exists a long felt need for hosiery which is not entirely ruined when only one area has a run or tear.

Further, as Shakespeare said, "The fashion wears out more apparel than the man," (Much Ado About Nothing, Act III, scene iii, line 147) although certainly the statement is applicable to persons regardless of gender. Hosiery in a single piece made from a single material does not permit changing the fashion without changing hosiery entirely—even if only a portion of the leg or only the ankle or foot is seen. Thus, even though the panty or upper leg or even lower leg or foot sections are not worn and are not seen, and may be perfectly usable, the wearer must change all sections of the hosiery just to change the fashion of what may be a small part. There thus exists a need for hosiery which may change in look or fashion without having to endure the expense and inconvenience of entirely changing hosiery itself.

In addition, body stockings have recently become very popular and are a fashionable item of apparel sold in many different styles and fashions by companies such as Victoria's Secret® and others, both by mail and by retail stores. While body stockings come in a great number of styles and fashions and are made of a variety of materials, they generally share the same common trait of being a single construction. Thus, even though such body stockings may extend from toe to shoulder, a run or snag at any point can ruin the entire body stocking. Also, as with pantyhose, there is presently no way to change the look or fashion of a given body stocking. Thus, there exists a need for body stockings which may change in look or fashion or not be entirely ruined by a run or tear.

SUMMARY OF THE INVENTION

The present invention relates to multisectional body stocking hosiery wherein a plurality of various sections are connected via non-protruding elastic attachment means. The body stocking hosiery may be of two or more parts and it may be designed to complement leg hosiery that may be of two or more sections. Each section may be of a different material or of similar materials. The materials themselves may provide for different functions, such as but not limited to, very elastic material for pregnant wearers, support hosiery materials, Spandex for athletic uses, or dressy materials such as patterned or variously colored nylon.

DETAILED DESCRIPTION OF THE DRAWING

Figure 1:
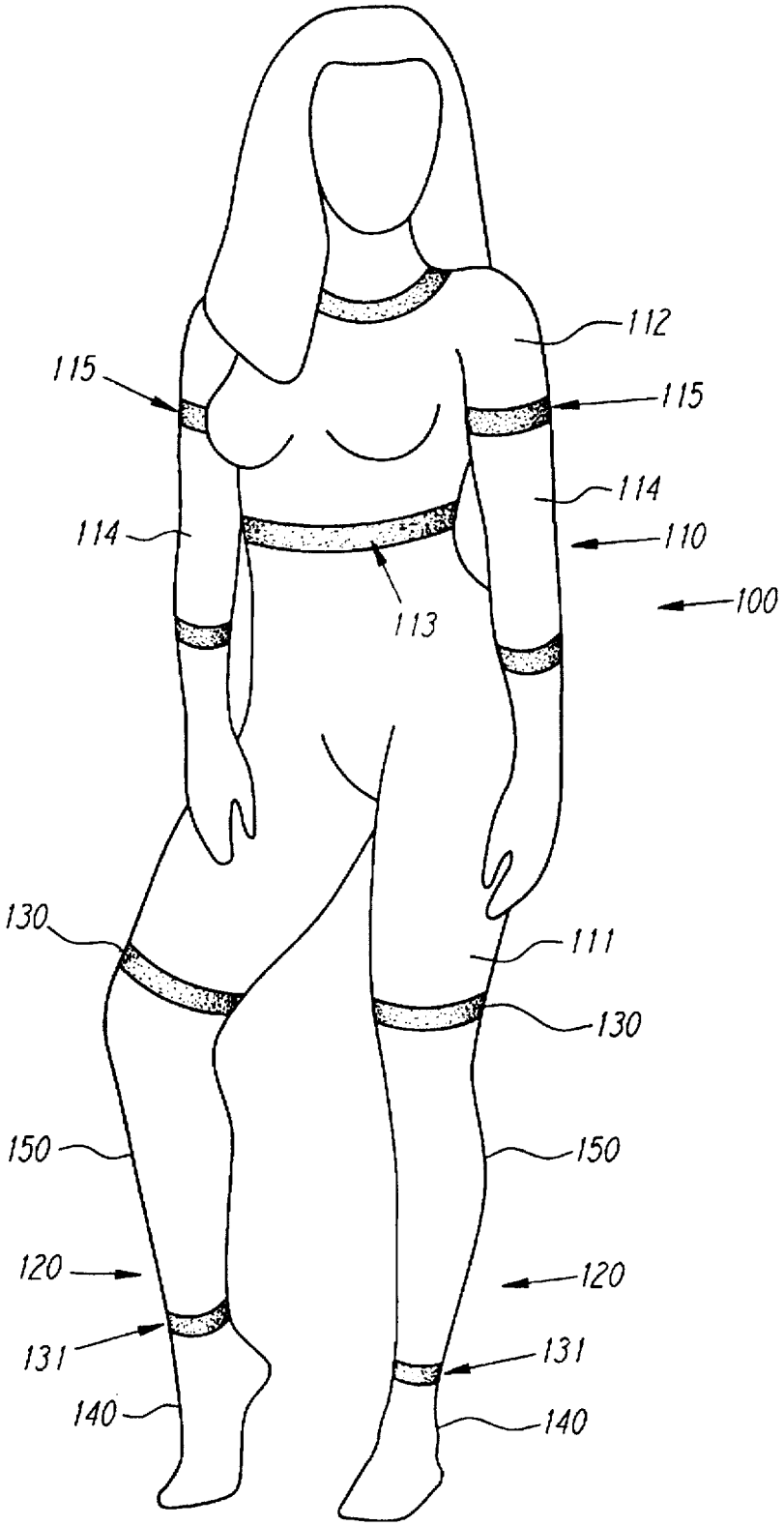

FIG. 1 represents one illustration of a multisectional body stocking hosiery garment according to the present invention.

DETAILED DESCRIPTION OF THE INVENTION

The present multisectional body stocking hosiery may be embodied in a wide variety of different forms to accommodate a wide variety of uses and styles. Generally, to outline the different parameters, the style, number of sections, materials and means for attachment of one section to another may be selected according to the individual need. A preferred embodiment of a multisectional body stocking hosiery according to the present invention, generally designated as 100, is depicted in FIG. 1. The multisectional body stocking has a body portion, generally designated 110, and a pair of leg portions, generally designated as 120, which are detachably connected to the body portion 110 by non-protruding elastic means 130 a shown in FIG. 1. In the embodiment shown, the body portion 110 is comprised of a lower body portion 111 detachably connected to upper body portion 112 by non-protruding elastic means, generally designated 113, and a pair of arm portions 114 are detachably connected to upper body portion 112 by non-protruding elastic means, generally designated 115. Each of the leg portions 120 has a foot portion 140 which is detachably connected to an upper leg portion 150 by additional non-protruding elastic means, generally designated 131. As shown in FIG. 1, the foot portions 140 do not extend above the wearer's knee, but in another alternative embodiment (not shown), the foot portions 140 do extend above the wearer's knee.

In the context of this invention, the body portion 110 and the leg portions 120 are all made of hosiery material unless there is a separate crotch portion (not shown) which may be made of a breathable material which need not be hosiery material. That is, the hosiery material is suitable as hosiery such as pantyhose stockings and body stockings, and not as some other garment, such as trousers, slacks or shorts. "Hosiery material" connotes the use of relatively flexible material, preferably fiber, such as nylon or silk, which is form fitting, and not baggy, inflexible fabrics. However, there are variations in hosiery material, and it is contemplated that preferred embodiments use several different materials for different parts of the pantyhose or multisectional body stocking hosiery system. For example, the body portion 110 may include a panty portion which may be of a full cut or a smaller cut, and made of various materials. Panty sections may be of a firmer nature, as what those skilled in the art call "control top." Leg sections may be seamed or unseamed, and foot sections may be sandal foot reinforced heels or toes or both. The materials also may be selected from a wide variety, recognizing that each section may be of the same material or different materials in combination. For example, maternity hosiery materials, support hosiery materials, surgical hosiery A-1 materials, different deniers of nylon materials, such as tights or sheer nylon, spandex, cotton-synthetic blends and other materials which are suitable for hosiery, may be selected. The wearer's selection may be based on health needs, such as for maternity, support, athletic needs, comfort needs, warmth or coolness of fabric. The wearer's selection may also be based on fashion needs, such as the selection of different colors or patterns, or different types of hosiery materials. For example, one may desire a maternity panty, and support upper thigh portion, but sheer over-the-knee section for style purposes.

Fashion body stocking hosiery is another preferred embodiment. The use of multiple detachable sections in the present invention allows the wearer the advantages of mixing and matching various materials, including fashion or dressy hosiery materials. For example, patterned hosiery materials may be used, or plain dressy materials with a sparkling effect may be used. Also, designs, such as airbrushed or tie-dyed designs may be used. Generally, fashion hosiery material is that material which includes an arbitrary, or at least non-functional design for fashion purposes, as opposed to the knit of the material as a result of its manufacture alone. Many other examples apart from those listed above would be apparent to one of ordinary skill in the art working from the illustrative examples disclosed herein.

The multiple detachable body stocking hosiery sections of the present invention include at least one non-protruding elastic means on one border, and in some cases, such as the pair of upper leg portions 150, two non-protruding elastic means, 130 and 131, to snugly fit the body. In a preferred embodiment, it is contemplated that the non-protruding elastic means be of a somewhat sheer material, such as a spandex, so as to generally conform to the form of the hosiery section. The non-protruding elastic means can also be a combination of materials, such as spandex and nylon. Thus, for example, previous hosiery articles such as knee or thigh highs have included such elastic means affixed to the non-elastic portion of the hosiery garment. The elastic portion of one hosiery section overlaps or connects two hosiery sections, and the overlap can be partial or complete. The elastic portion is preferably two to three inches, and may be of a separate elastic piece, or a knitted-in elastic piece, either flat or ribbed. In an especially preferred embodiment, one or more elastic piece may be used to give a stylish effect, such as by using lace, or patterned materials for the elastic connection to create a decorative design portion or create a garter type of appearance. For example, decorations could include buds, roses and other familiar flowers, dots, lines and swirly patterns, etc.

Presented below are a few examples of the present invention:

EXAMPLE 1

Athletic Body Stocking

The wearer may desire a body stocking for use in exercise such as aerobics where a pair of shorts might be worn on top of the body stocking. The body portion could include a pantyhose type portion with a breathable crotch portion and, depending upon the climate and time of year for intended use, optionally extend down to just above the knees, just below the knees, mid calf or just above the ankle and be a single unitary construction with or without sleeves. In this example, the body portion could be worn under clothes, such as a blouse and skirt, and the leg portions would still provide hosiery for the rest of the exposed leg. When the wearer wanted to exercise, the blouse, skirt and leg portions could be removed and then, optionally, athletic socks and/or shoes or a pair of athletic shorts could be added to complete an exercise outfit.

EXAMPLE 2

Intimate Body Stocking

The wearer may desire an intimate body stocking for wearing without any other clothes. The body portion could include a low-cut or see-through or strapless area above the waist without sleeves while the lower portion might be crotchless, a panty-type portion or even extend to the ankles. In such an embodiment, the body portion and the leg portions might be designed to create the appearance of a stocking held by a garter or a halter suspender type of outfit.

EXAMPLE 3

Camisole Replacement Body Stocking

The wearer might desire a multisectional body stocking hosiery outfit with all the benefits of detachable multisectional hosiery and a multiple piece body portion. The upper body portion could be detachable at the waist with elastic means or could be a single piece from the shoulder or chest, which could be a halter top style or strapless, with or without sleeves, to a panty portion. In such an embodiment, the body stocking could be decorative and could replace the necessity for a camisole.

In addition, all of the Examples disclosed in my co-pending application, Ser. No. 642,915, now U.S. Pat. No. 5,097,537 could also be incorporated, where appropriate, into the detachable multisectional body stocking hosiery.

As will be apparent to those skilled in the art in light of the preceding disclosure, many modifications, alterations, and substitutions are possible in the spirit of scope thereof. For example, in another preferred embodiment of the present invention, it is contemplated that the multisectional body stocking hosiery would have a pair of leg portions without any foot or anklet portion. Accordingly, the invention is not intended to be limited except as may be required by the lawful scope of the following claims in view of the preceeding disclosure.

I claim:

1. A multisectional body stocking made of hosiery material, comprising;

a pair of leg portions made of hosiery material; and a body portion made of hosiery material detachably connected to said pair of leg portions by a non-protruding elastic means, said body portion extending from said pair of leg portions to a portion of a body of a person wearing the body portion which is above the hips and proximate to the waist.

2. A multisectional body stocking as recited in claim 1, wherein said body portion is comprised of an upper body portion and a lower body portion which are detachably connected by a second non-protruding elastic means.

3. A multisectional body stocking as recited in claim 1, wherein said body portion and said pair of leg portions are made of different materials.

4. A multisectional body stocking as recited in claim 1, wherein said body portion and pair of leg portions have different decorative designs.

5. A multisectional body stocking as recited in claim 1, wherein at least one non-protruding elastic means contains a decorative design.

* * * * *